United States Patent [19]

Barriac

[11] 4,244,116

[45] Jan. 13, 1981

[54] DEVICES FOR MEASURING THE AZIMUTH AND THE SLOPE OF A DRILLING LINE

[75] Inventor: Jacques Barriac, Plaisir, France

[73] Assignee: Societe d'Applications Generales d'Electricite et de Mecanique (SAGEM), Paris, France

[21] Appl. No.: 962,712

[22] Filed: Nov. 21, 1978

[30] Foreign Application Priority Data

Dec. 2, 1977 [FR] France ..... 77 36335

[51] Int. Cl.[3] ..... G01C 19/38; E21B 47/024

[52] U.S. Cl. ..... 33/304; 33/312; 33/318

[58] Field of Search ..... 33/304, 302, 313, 318, 33/312

[56] References Cited

U.S. PATENT DOCUMENTS

| | | | |
|---|---|---|---|
| 3,753,296 | 8/1973 | Van Steenwyk | 33/304 |
| 3,938,256 | 2/1976 | Crocker | 33/318 |
| 4,071,959 | 2/1978 | Russell et al. | 33/313 |

*Primary Examiner*—William D. Martin, Jr.

*Attorney, Agent, or Firm*—Lane, Aitken, Ziems, Kice & Kananen

[57] ABSTRACT

The invention relates to devices for measuring the azimuth and the slope of a drilling line. These devices comprise, in a container 1, a gyroscope 5 having two principal axes of sensitivity X—X and Y—Y and an accelerometer 12 having two principal axes of sensitivity parallel to those of the gyroscope 5; this gyroscope 5 is connected to a circuit to determine the component of the Earth's rotation vector along the axis of the drilling line.

6 Claims, 4 Drawing Figures

DEVICES FOR MEASURING THE AZIMUTH AND THE SLOPE OF A DRILLING LINE

The invention relates to devices for measuring the azimuth and the slope of a drilling line, particularly a drilling line of an oil-well.

By azimuth of a drilling line is meant the angle formed by the horizontal projection of the axis of the drilling line with the horizontal projection of the vector of the Earth's rotation.

By slope of a drilling line is meant the angle formed by the axis of the drilling line with the gravity vector.

The use of devices is known which combine a gyroscope and an accelerometer for measuring the azimuth and the slope in a drilling line.

Thus it is that we know a device comprising a gyroscope for measuring the azimuth and an accelerometer for measuring the slope; in this device, the gyroscope and the accelerometer are mounted on a support which rotates about an axis merging with or parallel with that of the drilling line.

The disadvantage of such a device resides in the slowness with which the measurements are carried out and the complexity of the device, these two disadvantages being essentially due to the need to rotate the support of the gyroscope and the accelerometer.

The device in accordance with the invention has as an aim to remedy these disadvantages.

This device comprises a gyroscope and an accelerometer station disposed in a container equipped with retractable centering means so that it may be lowered into the drilling line at the end of a cable and interlocked with the section of the drilling line in which the measurement is to be carried out, and it is characterized by the fact that the gyroscope is a gyroscope with two principal axes of sensitivity disposed in the container, a principal axis of sensitivity being an axis along which direct measurements are made, so that its two principal axes of sensitivity are perpendicular to the axis of the drilling line, this gyroscope being connected to a circuit to determine the component of the Earth's rotation vector along the axis of the drilling line, and the accelerometer station has two principal axes of sensitivity and is disposed in the container so that its two axes of sensivity are perpendicular to the axis of the drilling line and parallel to those of the gyroscope, this accelerometer station being formed by one accelerometer with two principal axes of sensitivity or by two accelerometers with one principal axis of sensitivity.

The gyroscope gives the indication $\Omega_x$ and $\Omega_y$ which are the components according to the principal axes of sensitivity X—X and Y—Y of the gyroscope of the vector of rotation of the Earth $\vec{E}$ of which the modulus is known (15.041°/h).

From these indications, $\Omega_x$ and $\Omega_y$, can be deduced the component $\Omega_z$ of the vector of the Earth's rotation $\vec{E}$ according to the axis of the drilling line Z—Z.

$$\Omega_z = \sqrt{E^2 - \Omega_x^2 - \Omega_y^2}$$

The measurement of $\Omega_x$ and $\Omega_y$ and the calculation of $\Omega_z$ give then the azimuth of the drilling line.

The accelerometer station gives indications $A_x$ and $A_y$ which are the components according to the principal axes of sensitivity X—X and Y—Y of the gyroscope of the Earth's gravity vector G, the modulus of which is known (981 cm/s$^2$).

From these indications can be deduced the slope of the drilling line, i.e. the angle which axis Z—Z of this drilling line forms with the gravity vector G.

This slope I is such that $$\sin I = \frac{\sqrt{A_x^2 + A_y^2}}{G}$$

The invention consists, apart from the arrangements which have just been discussed, of certain other arrangements which are used preferably at the same time and which will be more explicitly discussed hereafter.

The invention will, in any case, be well understood with the help of the description which follows, and of the accompanying drawings, which relate to a preferred embodiment of the invention and of course are not limiting in character.

FIG. 1 of these drawings is a perspective view, with parts cut away, of a device constructed in accordance with the invention.

Figure 1:
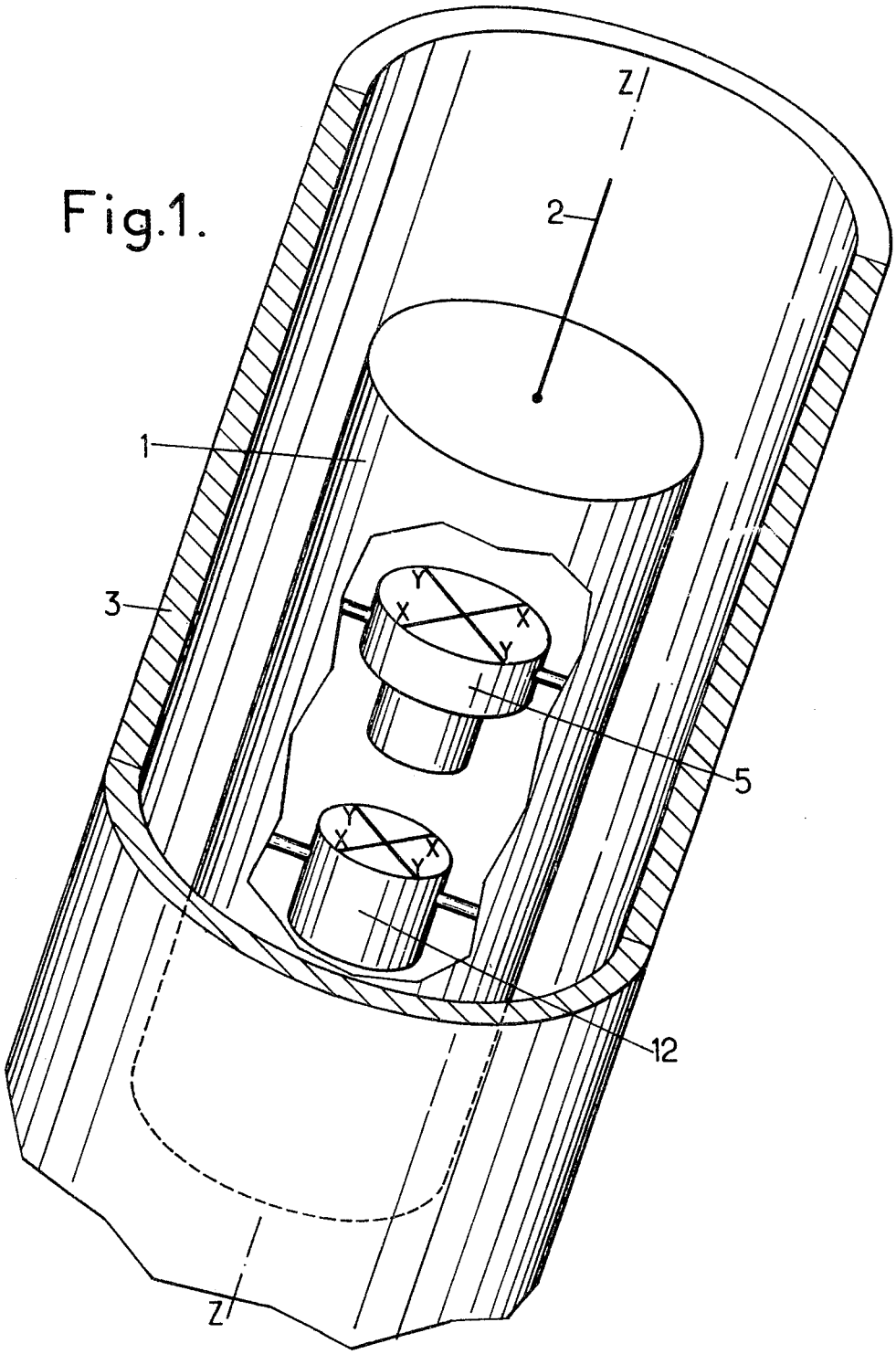

The device in accordance with the invention comprises then a gyroscope 5 and an accelerometer station 12 disposed in a container 1 suspended from a cable 2 so as to be able to be lowered to the place in the drilling line 3 where it is desired to measure the azimuth and the slope.

Figure 2:
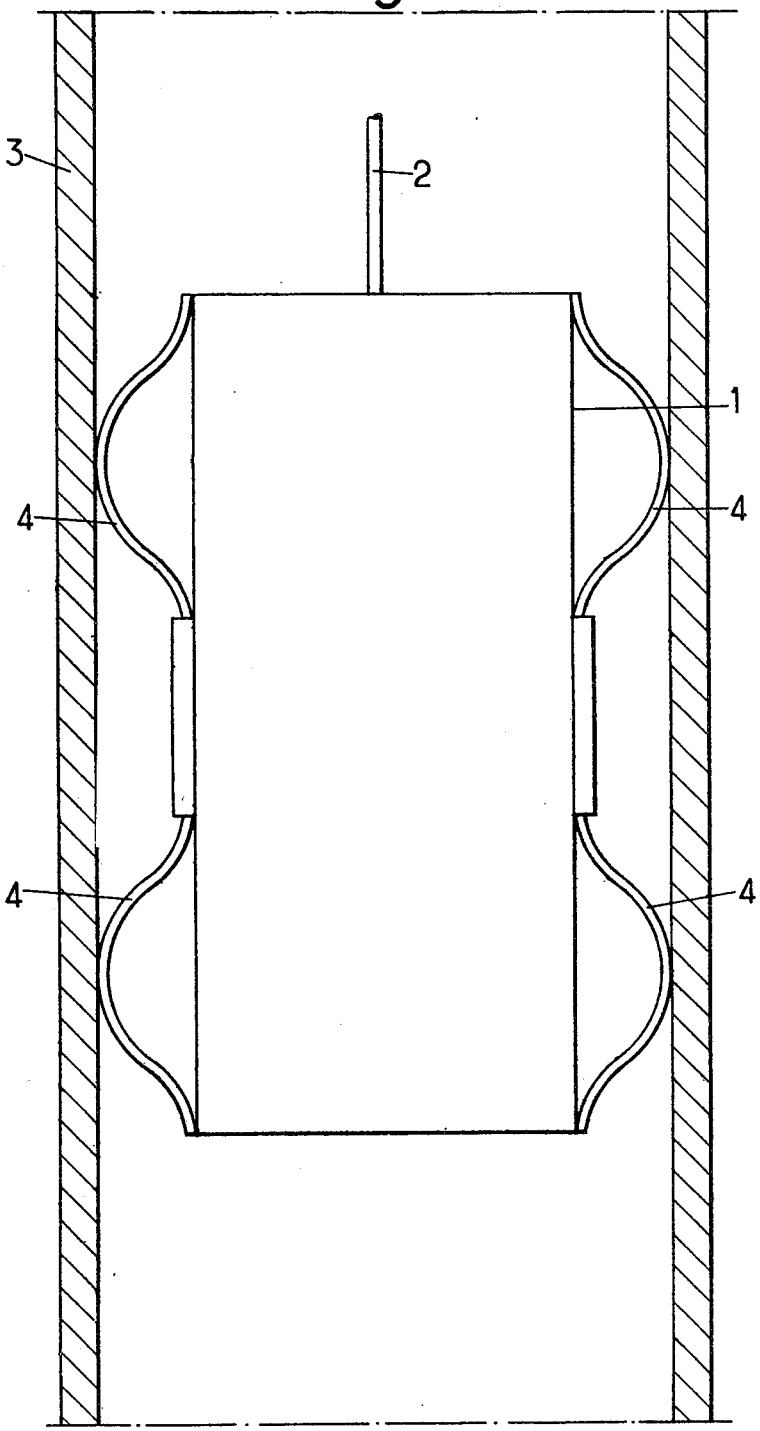
FIG. 2 is an elevational view of the device shown in FIG. 1.

This container 1 is equipped with retractable centering means 4, clearly visible in FIG. 2.

The gyroscope 5 of this device has two principal axes of sensitivity XX and YY and it is disposed in the container 1 so that these two principal axes of sensitivity XX and YY are perpendicular to the axis ZZ of the drilling line 3.

Figure 3:
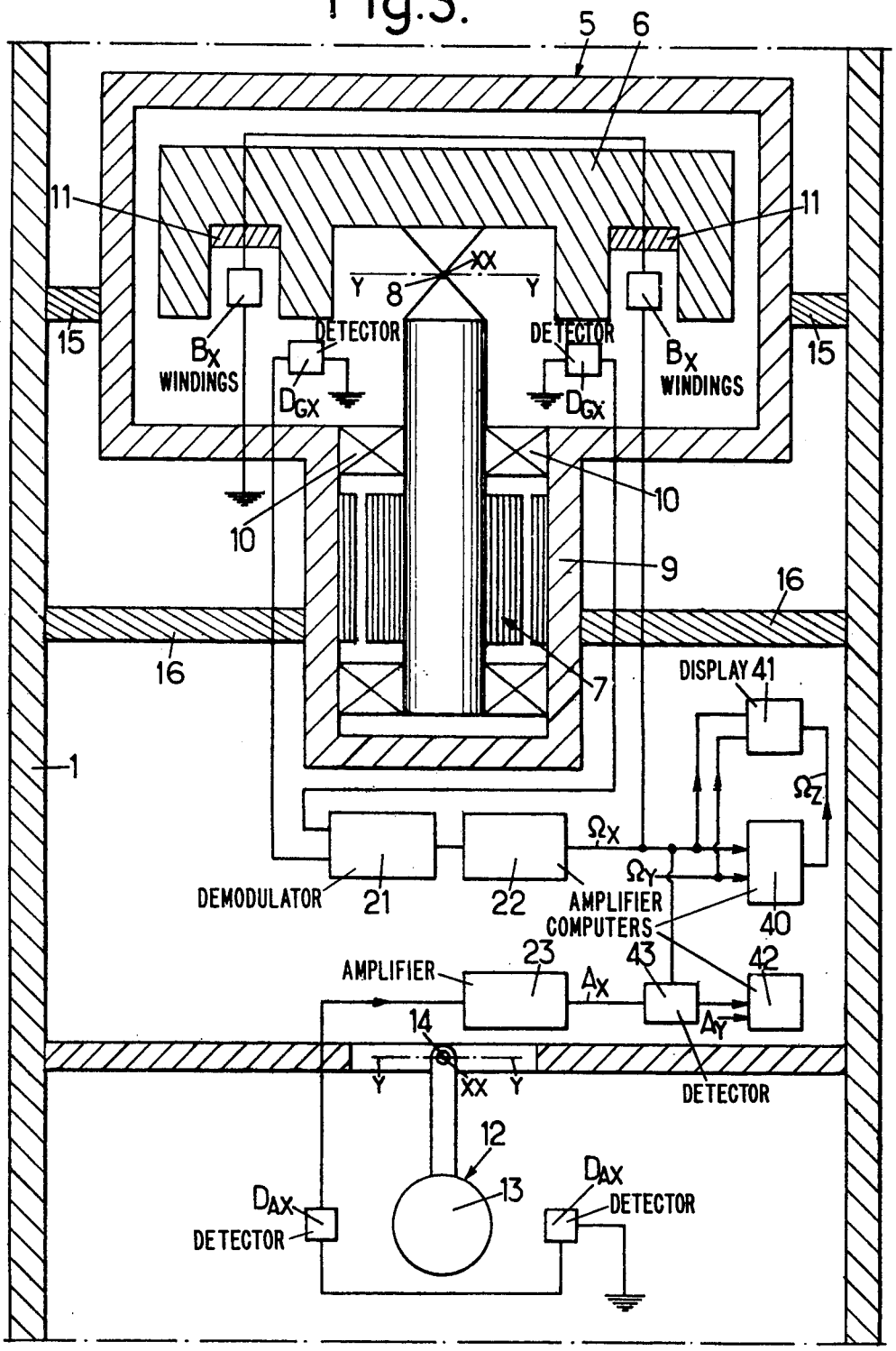
FIG. 3 is a simplified view of the device of FIG. 1 showing the elements which cooperate with one of the axes of sensitivity of the gyroscope, with electrical circuitry shown schematically.
Figure 4:
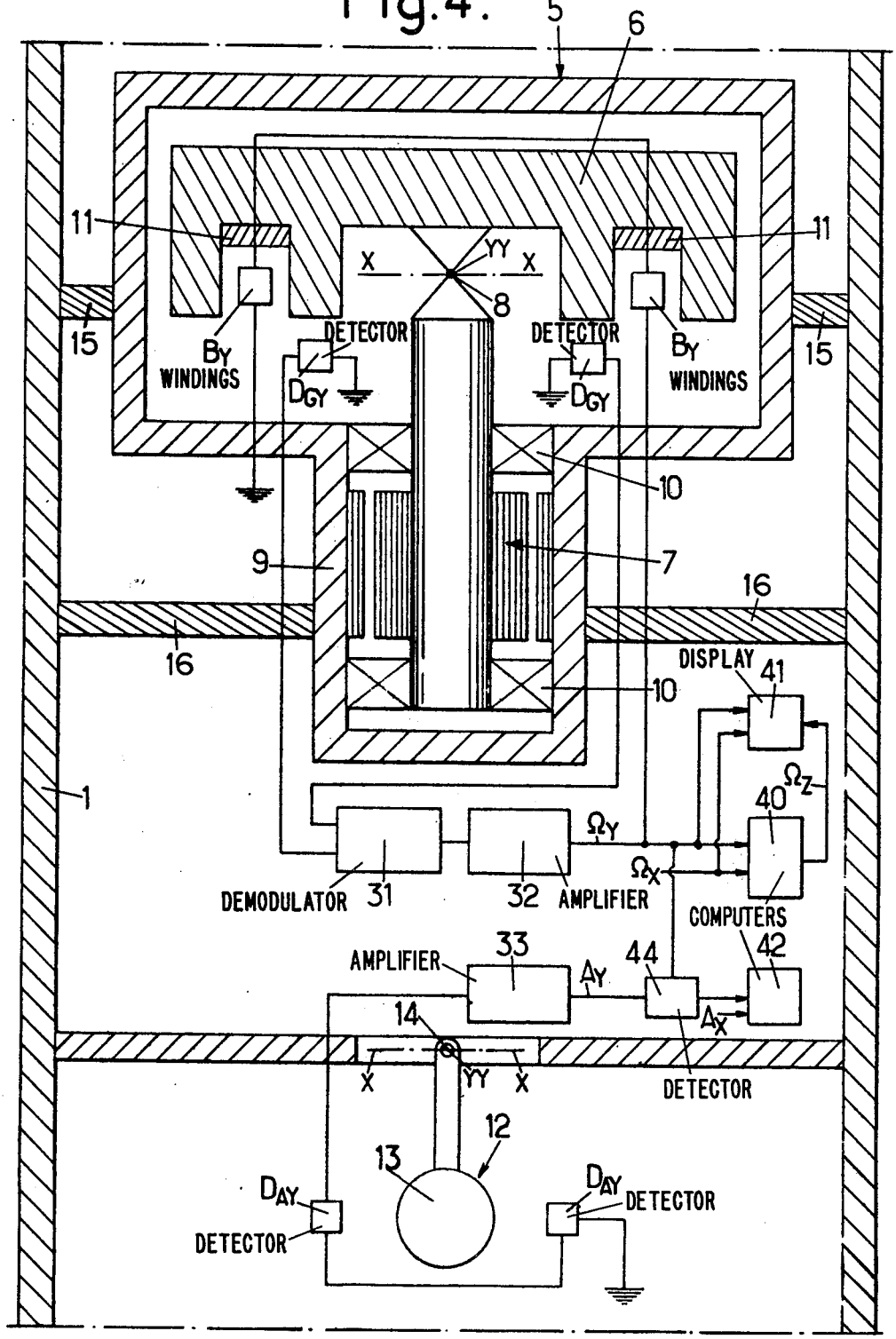
FIG. 4 is a simplified view of the device of FIG. 1 showing the elements which cooperate with the other axis of sensitivity of the gyroscope, with electrical circuitry shown schematically.

This gyroscope 5 comprises, as shown in FIGS. 3 and 4, an inertia flywheel 6 driven by a motor 7 through a gimbal joint 8 of the Hooke joint type, which is a universal joint including two horseshoe-shaped forks, each pivoted to a separate central member carrying two pins at right angles. The rotating parts of the gyroscope 5, situated on the other side of the inertia flywheel 6 in relation to the gimbal joint 8, are maintained in a housing 9 by means of bearings 10, the inertia flywheel 6 having an axis of rotation parallel to the axis of the drilling line 3. Structural members 15 and 16 are positioned between the housing 9 and the container 1.

The detection of the position of the inertia flywheel 6 about the axis of sensitivity XX is effected by detectors $D_{GX}$ (FIG. 3) and the detection of the position of the inertia flywheel 6 about the axis of sensitivity YY is effected by detectors $D_{GY}$ (FIG. 4).

In FIG. 3, the plane in which detectors $D_{GX}$ are to be found has been lowered into the plane of the drawing whereas in actual fact, detectors $D_{GX}$ are in a plane at 90° from that of the drawing.

In FIG. 4, the plane in which detectors $D_{GY}$ are to be found has been lowered into the plane of the drawing whereas, in actual fact, said detectors $D_{GY}$ are in a plane at 90° from that of the drawing.

A precessional torque motor comprising permanent magnets 11 mounted on the inertia flywheel 6 and fixed windings $B_x$ and $B_y$ allows a precessional torque to be imposed on said inertia flywheel 6.

This precessional torque is exerted, about axis XX if windings $B_x$ are excited (FIG. 3)

about axis YY if windings $B_y$ are excited (FIG. 4).

The accelerometer station 12 of this device has two principal axes of sensitivity and is disposed in container 1 so that its two principal axes of sensitivity are perpendicular to the axis ZZ of the drilling line 3, these two principal axes of sensitivity being then designated by XX and YY. It will be assumed that this accelerometer station 12 is advantageously formed by an accelerometer having two principal axes of sensitivity.

This accelerometer comprises, as shown in FIGS. 3 and 4, a pendulum mass 13 mounted about a frictionless point of articulation 14.

The detection of the position of pendulum mass 13 about the axis of sensitivity XX is effected by detectors $D_{AX}$ (FIG. 3) and detection of the position of pendulum mass 13 about the axis of sensitivity YY is effected by detectors $D_{AY}$ (FIG. 4).

As shown in FIG. 3, the stabilization error information delivered by detectors $D_{GX}$ of gyroscope 5 corresponding to its axis of sensitivity XX is fed into a synchronous demodulator 21 which delivers a single signal which is then amplified in a continuous amplifier 22 which then delivers signal $\Omega_x$.

This signal $\Omega_x$ is fed to the windings $B_x$ of the permanent magnet precessional torque motor.

As shown in FIG. 4, the stabilization error information delivered by detectors $D_{GY}$ of gyroscope 5 corresponding to its axis of sensitivity YY is fed into a synchronous demodulator 31 which delivers a single signal which is then amplified in a continuous amplifier 32 which then delivers the signal $\Omega_y$.

This signal $\Omega_y$ is fed to the windings $B_y$ of the permanent magnet precessional torque motor.

These signals $\Omega_x$ and $\Omega_y$ are, moreover, used in a computer 40 to formulate the $\Omega_z$ components of the vector of the Earth's rotation E according to the axis of drilling line ZZ.

This computer 40 carries out the operation $$\Omega_z = \sqrt{E^2 - \Omega_x^2 - \Omega_y^2},$$

E being the modulus of the vector of the Earth's rotation.

The azimuth of the drilling line is then given by the measured values $\Omega_x$ and $\Omega_y$ and the calculated value $\Omega_z$ which are fed into a display device 41.

As shown in FIG. 3, the information delivered by detectors $D_{AX}$ of accelerometer 12 corresponding to its axis of sensitivity XX are amplified in an amplifier 23 which then delivers the signal $A_x$.

As shown in FIG. 4, the information delivered by detectors $D_{AY}$ of accelerometer 12 corresponding to its axis of sensitivity YY are amplified in an amplifier 33 which then delivers the signal $A_y$.

These signals $A_x$ and $A_y$ are used in a computer 42 which calculates, according to the formula below, the slope I of the drilling line, i.e. the angle formed by its axis ZZ with the gravity vector G:

$$\sin I = \frac{\sqrt{A_x^2 + A_y^2}}{G}$$

G being the modulus of the gravity vector of the Earth. As is known in the art, computers suitable for the use as the computers 40 and 42 include digital computers and analog computers. In the case of a digital computer, voltage signals, such as those derived from the $\Omega_x$ and $\Omega_y$ signals and from the $A_x$ and $A_y$ signals, are converted to digital form by appropriate analog-to-digital converters and operated upon by a suitably controlled arithmetic logic unit to provide the desired $\Omega_z$ and sin I outputs. In the case of an analog computer, analog computing elements having the appropriate transfer-function characteristics are combined to accept signals, such as the $\Omega_x$ and $\Omega_y$ and $A_x$ and $A_y$ signals, as inputs and provide, respectively, desired outputs, such as the $\Omega_z$ and sin I outputs.

It is advantageous to provide two detector devices analyzing respectively the variations of signals $A_x$ and $A_y$ during gyrometric measurements, these detector devices acting to correct possibly the values of signals $\Omega_x$ and $\Omega_y$.

Therefore, if, during the period of measurement, container 1 has swung about axis XX or axis YY (which is always possible in a drilling line, even at rest), this swinging movement is detected by accelerator 12 and a correction is effected on signals $\Omega_x$ and/or $\Omega_y$.

The parts 40 (computer), 41 (display device), 42 (computer), 43 and 44 (detectors) are situated on the ground and receive signals $\Omega_x$, $\Omega_y$, $A_x$ and $A_y$ by electrical connections which are incorporated in cable 2 supporting container 1.

As is evident, and as it follows moreover already from what has gone before, the invention is in no wise limited to those of its embodiments and modes of application which have been more especially considered; it embraces, on the contrary, all variations thereof.

I claim:

1. A device for measuring the azimuth and the slope of a drilling line, comprising gyroscope means and accelerometer means disposed in a container equipped with retractable centering means so that it may be lowered into the drilling line at the end of a cable and interlocked with the section of the drilling line in which the measurement is to be effected, the gyroscope means being comprised by a gyroscope with two principal axes of sensitivity disposed in the container so that its two principal axes of sensitivity are perpendicular to the axis of the drilling line, the gyroscope including an inertia flywheel having an axis of rotation parallel to the axis of the drilling line, and the accelerometer means being comprised by an accelerometer with two principal axes of sensitivity disposed in the container so that its two principal axes of sensitivity are perpendicular to the axis of the drilling line and parallel to those of the gyroscope.

2. A device for measuring the azimuth and the slope of a drilling line, comprising gyroscope means and accelerometer means disposed in a container equipped with retractable centering means so that it may be lowered into the drilling line at the end of a cable and interlocked with the section of the drilling line in which the measurement is to be effected, the gyroscope means being comprised by a gyroscope with two principal axes of sensitivity disposed in the container so that its two principal axes of sensitivity are perpendicular to the axis of the drilling line, the gyroscope including an inertia flywheel having an axis of rotation parallel to the axis of the drilling line, and the accelerometer means being comprised by two accelerometers with one principal axis of sensitivity disposed in the container so that their respective principal axes of sensitivity are perpendicular to the axis of the drilling line and parallel to those of the gyroscope.

3. A device according to claim 1 or 2, in which first calculator means are provided for calculating the component $\Omega_z$ of the vector of the Earth's rotation according to the axis of the drilling line ZZ, these first calculator means effecting the operation $$\Omega_z = \sqrt{E^2 - \Omega_x^2 - \Omega_y^2},$$

and second calculator means are provided for calculating the slope I of the axis ZZ of the drilling line with the gravity vector, these second calculator means effecting the operation $$\sin I = \frac{\sqrt{A_x^2 + A_y^2}}{G}$$

4. A device according to claim 3 in which means are provided for using the components $\Omega_x$, $\Omega_y$ and $\Omega_z$ of the vector of rotation of the Earth according to the axes X—X, Y—Y and Z—Z for the determination of the azimuth of the drilling line.

5. A device according to claim 3 in which means are provided for using the variations of signals $A_x$ and $A_y$ for correcting the value of signals $\Omega_x$ and/or $\Omega_y$.

6. A device according to claim 4 in which means are provided for using the variations of signals $A_x$ and $A_y$ for correcting the value of signals $\Omega_x$ and/or $\Omega_y$.

* * * * *